US005548383A

United States Patent [19]

Endoh

[11] Patent Number: 5,548,383

[45] Date of Patent: Aug. 20, 1996

[54] DEVELOPING DEVICE FOR CONTROLLING PRESSURE BETWEEN TONER CONVEYING UNITS

[75] Inventor: Shuichi Endoh, Isehara, Japan

[73] Assignee: Ricoh Company, Ltd., Tokyo, Japan

[21] Appl. No.: 414,595

[22] Filed: Mar. 31, 1995

[30] Foreign Application Priority Data

Apr. 1, 1994 [JP] Japan ..... 6-065017

[51] Int. Cl.[6] ..... G03G 15/08

[52] U.S. Cl. ..... 355/259; 118/653

[58] Field of Search ..... 355/259; 118/653

[56] References Cited

U.S. PATENT DOCUMENTS 5,179,414 1/1993 Bhagat ..... 355/259

FOREIGN PATENT DOCUMENTS 56-40861 4/1981 Japan .
6-19284 2/1993 Japan .
6-175477 6/1994 Japan .
5-27567 2/1996 Japan .

*Primary Examiner*—Joan H. Pendegrass
*Assistant Examiner*—Sophia S. Chen
*Attorney, Agent, or Firm*—Oblon, Spivak, McClelland, Maier & Neustadt, P.C.

[57] ABSTRACT

In an image forming apparatus, a developing device for developing a latent image electrostatically formed on an image carrier by toner has a first rotatable conveying member for causing the toner to deposit thereon, a regulating member for regulating the amount of toner deposited on the first conveying member, and a second conveying member for causing the toner transferred from the first conveying member and regulated by the regulating member to deposit thereon, and supplying the toner to the latent image. The pressure of the regulating member, abutting against the first conveying member, includes a component parallel to a line connecting the axes of the first and second conveying members, and directed from the axis of the first conveying member toward the axis of the second conveying member. The pressure further includes a component parallel to a line connecting the axis of the second conveying member and the axis of the image carrier, and directed from the axis of the second conveying member toward the axis of the image carrier.

6 Claims, 10 Drawing Sheets

DEVELOPING DEVICE FOR CONTROLLING PRESSURE BETWEEN TONER CONVEYING UNITS

BACKGROUND OF THE INVENTION

1. Field of the Invention

The present invention relates to a copier, facsimile apparatus, laser printer or similar image forming apparatus and, more particularly, to a bistage type developing device having a photoconductive drum or similar image carrier, a developing roller or similar first toner conveying means, and a roller or second conveying means intervening between the image carrier and the first toner conveying means.

2. Discussion of the Background

It is a common practice with a developing device to use toner of high electric resistance, as distinguished from a toner and carrier mixture. This kind of developing devices are generally classified into three types, i.e., an S-NSP type device using a soft developing roller, a μ-ISP type device using a hard developing roller, and a bistage μ-ISP type device having second toner conveying means between a photoconductive element or similar image carrier and first toner conveying means.

In the S-NSP type device, toner deposited on the developing roller is regulated by a blade to form a thin layer and then conveyed to a photoconductive drum or image carrier. The drum is made of a hard material. Hence, the developing roller is made of rubber or similar soft material. As a result, a nip necessary for development is formed between the roller and the drum. On the other hand, in the μ-ISP type device, the toner is leveled by the blade and charged mainly by the friction between the blade and the toner and the friction between the particles of the toner themselves. Because the developing roller is hard, use is made of a photoconductive belt. The hard roller and belt form a nip therebetween. Further, in the bistage μ-ISP type device, second toner conveying means in the form of a belt is interposed between the first toner conveying means and the image carrier, as taught in Japanese Patent Laid-Open Publication No. 61-34557 by way of example.

However, the S-NSP type device using a soft developing roller has various problems, as follows.

(1) The soft developing roller makes it difficult for the blade to form a uniform thin toner layer thereon.

(2) The soft developing roller is apt to suffer from creep deformation (perpetual compression distortion) and fail to uniformly contact the blade and image carrier, resulting in defective images.

(3) It is difficult to uniformly charge the toner. As a result, toner particles charged to the opposite polarity appear and contaminate the background of images.

The above problems (1) and (2) are attributable to the soft developing roller and, therefore, do not occur in the μ-ISP type device. However, the μ-ISP type device brings about the following drawbacks.

(4) The photoconductive belt must be accompanied by a belt drive mechanism, including a drive roller and gears, which increases the cost.

(5) The photoconductive belt becomes offset to either side due to, for example, the irregular tension distribution of the belt. Hence, a mechanism for preventing such a n occurrence is required.

The toner particles charged to the opposite polarity, as in the above problem (3), occur even when use is made of a hard developing roller. The bistage μ-ISP type device is a measure proposed against the oppositely charged toner particles. This type of device, however, also has the problems stated in relation to the μ-ISP type device using a hard developing roller because the second toner conveying means is implemented as a belt.

In light of the above, a developing device having a second toner conveying means in the form of a roller has already been proposed. Although this kind of device obviates the problem attributable to the oppositely charged toner at low cost, it is not fully satisfactory in respect of the prevention of defective images.

SUMMARY OF THE INVENTION

It is, therefore, an object of the present invention to provide a bistage μ-ISP type developing device for image forming apparatus which prevents defective images from being produced.

In accordance with the present invention, a developing device for a developing apparatus and for developing a latent image electrostatically formed on an image carrier by toner has a first rotatable conveying member for causing the toner to deposit thereon, a regulating member for regulating the amount of toner deposited on the first conveying means, and a second conveying member for causing the toner transferred from the first conveying member and regulated by the regulating member to deposit on the second conveying member, and for supplying the toner to the latent image. The pressure of the regulating member, abutting against the first conveying member, includes a component parallel to a line connecting the axes of the first and second conveying members, and directed from the axis of the first conveying member to the axis of the second conveying member. The pressure further includes a component parallel to a line connecting the axis of the second conveying member and the axis of the image carrier, and directed from the axis of the second conveying member toward the axis of the image carrier.

Also, in accordance with the present invention, a developing device for a developing apparatus and for developing a latent image electrostatically formed on an image carrier by toner has a first rotatable conveying member for causing the toner to deposit thereon; a regulating member for regulating the amount of toner deposited on the first conveying member, and a second conveying member for causing the toner transferred from the first conveying member and regulated by the regulating member to deposit thereon, and for supplying the toner to the latent image. The resultant of a force exerted, during development, on the axis of the second conveying member by friction and a force exerted on the axis of the second conveying member by friction between the second conveying member and the image carrier includes a component parallel to a line connecting the axis of the image carrier and the axis of the second conveying member, and directed from the axis of the second conveying member toward the axis of the image carrier.

Further, in accordance with the present invention, a developing device for a developing apparatus and for developing a latent image electrostatically formed on an image carrier by toner has a first rotatable conveying member for causing the toner to deposit thereon, a regulating member for regulating the amount of toner deposited on the first conveying means, and a second conveying member for causing. the toner transferred from the first conveying member and regulated by the regulating means to deposit thereon, and for supplying the toner to the latent image. The resultant of a force exerted, during development, on the axis of the second conveying member by friction between the first and second conveying members and a force exerted on the axis of the second conveying member by friction between the second conveying member and the image carrier is contained in smaller one of the angles between a line connecting the axis of the first conveying member and the axis of the second conveying member and a line connecting the axis of the second conveying member and the axis of the image carrier.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
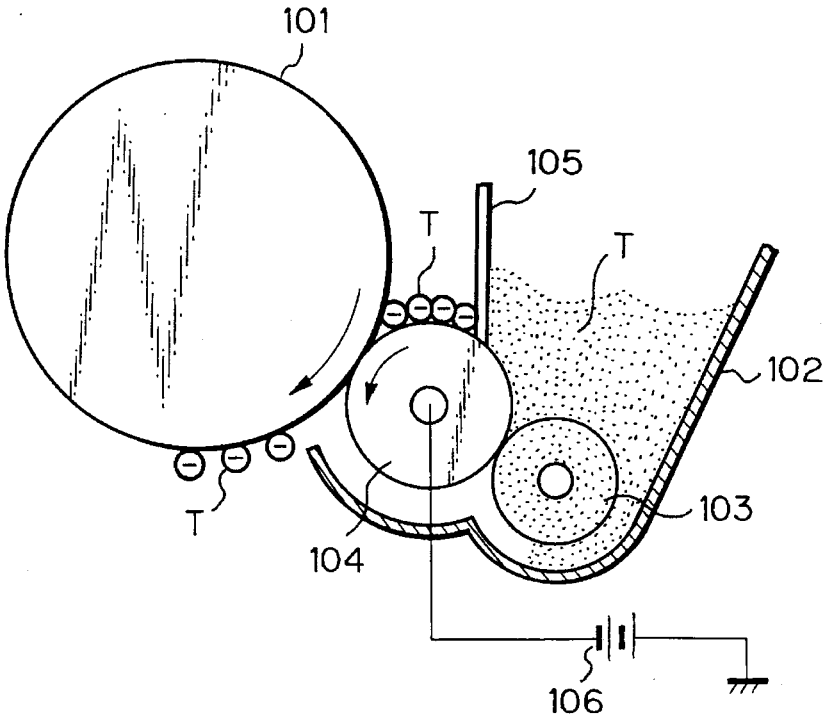
Fig. 1 PRIOR ART
FIG. 1 is a section showing a conventional S-NSP type developing device.

To better understand the present invention, a brief reference will be made to a conventional S-NSP type developing device, shown in FIG. 1. As shown, the developing device has a toner supply roller 103 and a developing roller 104. Toner T is stored in a hopper 102 and charged mainly by the friction between the two rollers 103 and 104. A high-tension power source 106 applies a bias to the developing roller 104, so that the toner T is electrostatically deposited on the roller 104. While the developing roller 104 conveys the toner T, a blade 105 levels the toner T to form a thin toner layer on the roller 104. The thin toner layer is brought to a developing position where the developing roller 104 faces a photoconductive element in the form of a drum 101. The drum 101 is made of a hard material. Hence, t h e developing roller 104 is made of rubber or similar soft material. As a result, a nip necessary for development is formed between the roller 104 and the drum 101.

Figure 2:
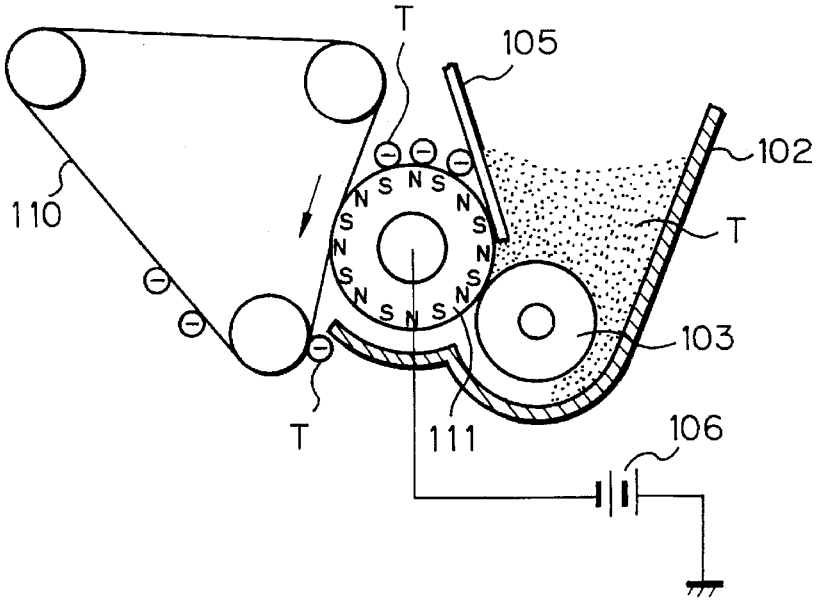
Fig. 2 PRIOR ART
FIG. 2 is a section showing a conventional μ-ISP type developing device.

FIG. 2 shows a conventional μ-ISP type developing device. In this type of device, toner T is magnetically deposited on a developing roller 111 made of a hard material. The toner on the developing roller 111 is leveled by the blade 105 and charged mainly by the friction between the blade and the toner T and the friction between the particles of the toner T themselves. The developing roller 111 faces a photoconductive element implemented as a belt 110 at a developing position. The hard roller 111 and the belt 110 form a nip therebetween.

The conventional developing device, whether it be of the S-NSP type or of the μ-ISP type or of the bistage μ-ISP type mentioned earlier, has various problems left unsolved, as discussed previously.

The present invention which obviates the problems of the conventional developing devices will be described with reference to the accompanying drawings.

Figure 3:
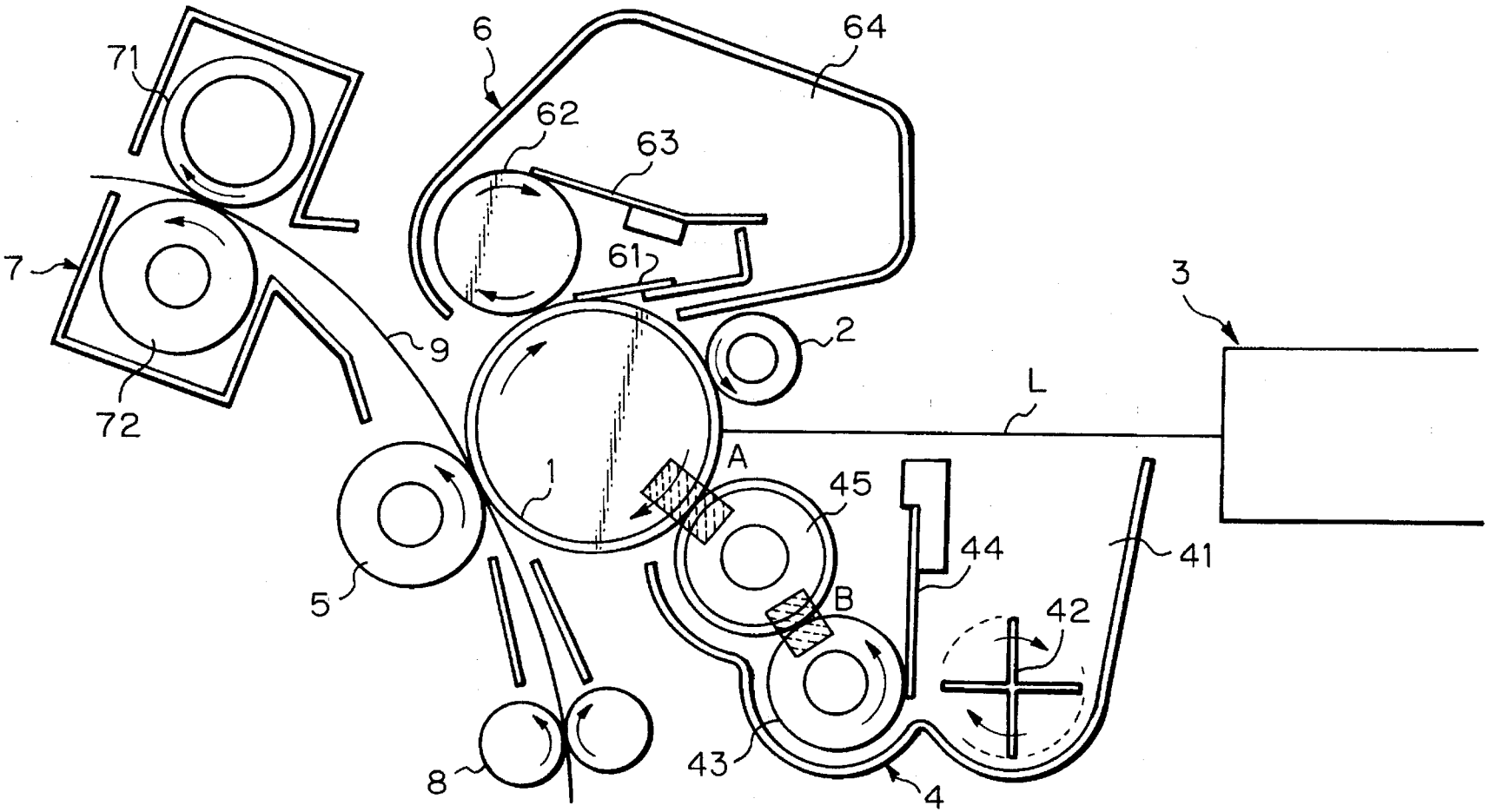
FIG. 3 is a fragmentary section of an image forming apparatus to which the present invention is applicable.

Referring to FIG. 3, an image forming apparatus to which the present invention is applicable is shown. As shown, the apparatus has a photoconductive element in the form of a drum 1. Arranged around the drum 1 are a charger (charge roller) 2, a developing device 4, an image transfer member (transfer roller) 5, a cleaning unit 6 and other electrophotographic process units. An optical writing unit 3 (laser optics) 3 is located at the right-hand side of the electrophotographic process units. A paper cassette, not shown, is disposed below the laser optics 3.

The developing device 4 has first rotatable conveying means 43 for supplying toner to second rotatable conveying means 45. The second conveying means 45 deposits the toner on a latent image electrostatically formed on the drum 1 which is also rotatable. Toner regulating means 44 regulates the amount of toner on the first conveying means 43. The reference numerals 41 and 42 designate a toner hopper and an agitator, respectively. Voltage applying means, not shown, applies a particular voltage to each of the first and second conveying means 43 and 45 and so forth. The drum 1 and first and second conveying means 43 and 45 will be sometimes referred to as rotary bodies, as the case may be. The cleaning unit 6 has a cleaning blade 61, a toner collecting roller 62, a toner removing blade 63, and a toner storing space 64. A fixing unit 7 has a heat roller 71 and a press roller 72. There are also shown in FIG. 3 a registration roller pair 8 and a paper 9.

In operation, the drum 1 is rotated clockwise, as indicated by an arrow in FIG. 3. An image is formed on the drum 1 and then transferred from the drum 1 to the paper 9 to produce a hard copy. Specifically, the surface of the drum 1 is uniformly charged by the charger 2. A laser beam L, issuing from the laser optics 3, scans the charged surface of the drum 1 to electrostatically form a latent image thereon. When the latent image is brought to the developing device 4, the device 4 deposits toner on the latent image by an electric field and thereby produces a corresponding toner image. The operation of the developing device 4 will be described in detail later. The toner image is transferred from the drum 1 to the paper 9 by the transfer member 5. The paper 9 with the toner image is separated from the drum 1 and then conveyed to the fixing unit 7. The fixing unit 7 fixes the toner image on the paper 9 by heat and pressure. The resulting hard copy is driven out of the apparatus.

After the image transfer, the toner remaining on the drum 1 is removed by the cleaning unit 6. Then, the drum 1 is again uniformly charged by the charger 6 to prepare for the next image formation.

Before the drum 1 is charged, it may be illuminated to erase charges also remaining on the drum 1. This will ensure the desirable charging of the drum 1. The charger 2 and image transfer member 5 may each be implemented by a conventional corona charger in place of the roller, if desired. Of course, the laser optics may be replaced with an LED (Light Emitting Diode) array or even with a focusing device customarily installed in an analog copier.

The operation of the developing device 4 will be described specifically. The agitator 42 feeds toner from the toner hopper 41 to the first conveying means 43. Assume that the developing device 4 stores a magnetic toner, as distinguished from a toner and carrier mixture. Then, to deposit the toner on the first conveying means 43, the conveying means 43 is implemented as a roller capable of forming a magnetic field and attracting the toner by magnetism. Even when use is made of a nonmagnetic toner, it can be electrostatically deposited on the conveying means 43 by being rubbed against the means 43 (a rubbing member is not shown). At this stage, the toner on the first conveying means 43 is unstable in charging condition and irregular in amount. While the first conveying means 43 is rotated counterclockwise, the toner regulating means 44, contacting the conveying means 43, removes an excessive part of the toner from the conveying means 43. At the same time, the amount of charge of the toner is stabilized when the toner is passed through between the conveying means 43 and regulating means 44. As a result, an adequate amount of toner is deposited on the conveying means 43 in a uniform layer. The first conveying means 43 contacts the second conveying means at a position B shown in FIG. 3. The second conveying means 45 rotates in sliding contact with the first conveying means 43.

The power source, not shown, applies a particular voltage to each of the first and second conveying means 43 and 45. During image formation, the voltages are conditioned such that the toner is transferred from the first conveying means 43 to the second conveying means 45. For example, assume that the toner is chargeable to a negative polarity, and that voltages V1 and V2 are applied to the first and second conveying means 43 and 45, respectively. Then, if the voltage V2 is selected to be higher than the voltage V1, there is formed at the position B an electric field which causes the negatively charged toner to move toward the second conveying means 45. Conversely, if the voltage V2 is lower than the voltage V1, the toner is urged toward the first conveying means 43 by an electric force. This makes it possible to cause the toner to scarcely move from the first conveying means 43 to the second conveying means 45. When the toner is chargeable to a positive polarity, a relation opposite the above-stated relation holds. Although the direction in which the second conveying means 45 rotates is not shown in FIG. 3, the expected toner layer can be formed on the conveying means 45 without regard to the direction of rotation.

In the above condition, toner particles charged to the opposite polarity and left on the first conveying means 43 in a small amount are prevented from being transferred to the second conveying means 45 due to the toner layer formed on the second conveying means 45. Of course, the object of the present invention stated earlier is also achieved with the toner layer on the second conveying means 45.

The amount of toner to deposit on the second conveying means 45 can be changed over a certain range if the rotation speeds of the first and second conveying means 43 and 45 are adequately selected. Specifically, the toner can deposit on the conveying means 45 in an amount of 0.7 mg/cm$^2$ or above with a stable charge. Such an amount of toner deposition has heretofore been difficult to achieve due to a great amount of uncharged toner. The uncharged toner would fly about to contaminate the interior of the apparatus and would lead to the oppositely charged toner mentioned above. Further, it is possible to prevent the toner from depositing on the second conveying means 45 and, therefore, on the drum 1 when image formation is not under way.

The second conveying means 45 contacts the drum 1 at a position A shown in FIG. 3 and rotates in sliding contact therewith. If the voltage V2 for the second conveying means 45 is adequately selected in relation to the potential contrast of the latent image formed on the drum 1, the toner can be transferred from the conveying means 45 to the drum 1 in accordance with the latent image pattern by an electric field extending from the conveying means 45.

In FIG. 3, the direction of rotation of the drum 1 is restricted (clockwise) by the path for the transport of the paper 9, but the direction of rotation of the second conveying means 45 is free from such a restriction. Specifically, development is achievable without regard to the direction in which the conveying means 45 rotates.

The prerequisite with the developing system described above is that adjoining ones of the rotary members, i.e., drum 1 and first and second conveying means 43 and 45 be surely held in contact with each other. If the contact of the two conveying means 43 and 45 is defective, the transfer of the toner from the conveying means 43 to the conveying means 45 will fail. If the contact of the conveying means 45 and the drum 1 is defective, development will not be effected. In any case, defective contact causes image data to be lost.

The contact width, or nip width, between the first and second conveying means 43 and 45 and the contact width between the second conveying means 45 and the drum 1 are implemented by fixing the axes of such rotary bodies and causing the rotary bodies to bite into each other in a predetermined amount. Hence, if all of the rotary bodies are made of a hard material which is scarcely deformable, the contact pressure between them will increase and make it difficult to implement such a biting configuration mechanically. In such a case, the photoconductive element must be implemented as a belt. In light of this, the second conveying means 45 may be made of a deformable material in order to use a photoconductive drum, or the first conveying means 43 and drum 1 may be made of a deformable material.

However, when the second conveying means 45 is made of a deformable material in order to use a scarcely deformable drum, the following problems are given rise to. The contact conditions between the second conveying means 45 and the drum 1 and between the first and second conveying means 43 and 45 change during operation due to the mechanical dimensional accuracy, the jitter of the axes, the play of bearings, etc. To maintain the contact despite such a change, the rotary bodies may be caused to bite into each other in an amount greater than the amount of change. This, however, brings about another problem that the amount of bite is excessive at the extreme point, causing an excessive contact pressure to act between the rotary bodies. As a result, the lives of the rotary bodies, as well as the lives of bearings and drive sections, are reduced due to friction.

To stabilize the contact between the adjoining rotary bodies without reducing their lives, the present invention causes forces to act in the direction of contact with the minimum arrangement shown in FIG. 3.

Embodiments of the contact structure in accordance with the present invention will be described hereinafter. In the embodiments, constituents corresponding to the constituents shown in FIG. 3 are designated by the same reference numerals, and a detailed description thereof will not be made in order to avoid redundancy.

1st Embodiment

Figure 4:
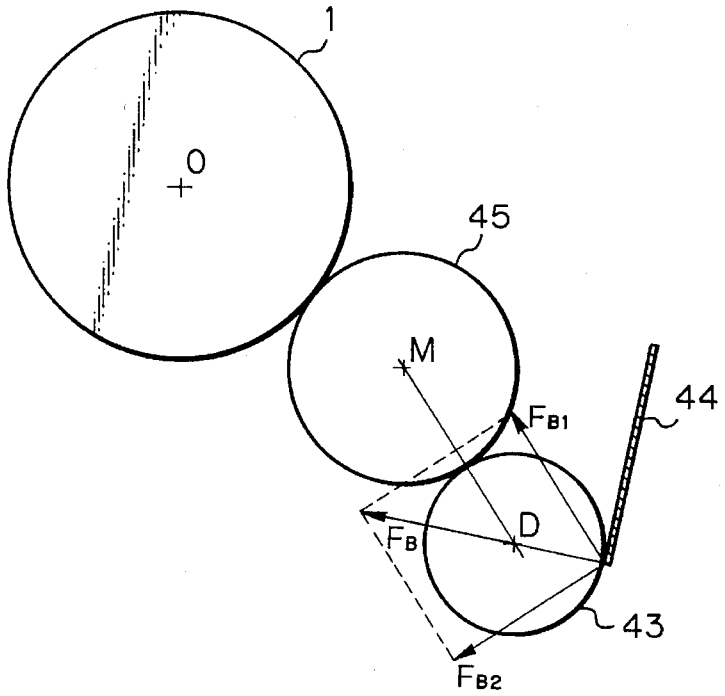
FIGS. 4 and 5 show the contact structure of rotary bodies in accordance with a first embodiment of the present invention and including first and second toner conveying means.
Figure 5:
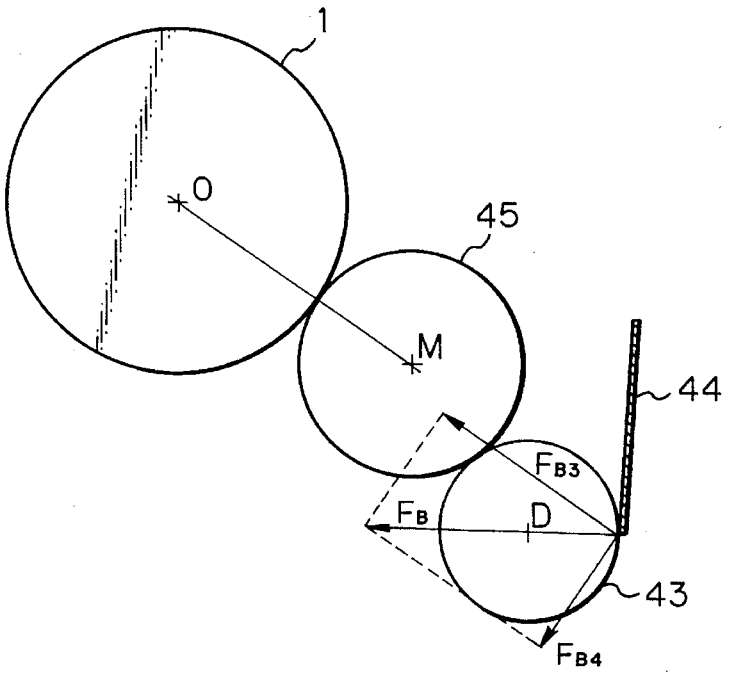

As shown in FIG. 4, the toner regulating means 44 abuts against the first conveying means 43 with a force $F_B$. The first and second conveying means 43 and 45 respectively have axes D and M which are connected by a line DM. The force $F_B$is divided into a component $F_{B\ 1}$ extending in the direction of the line DM, and a component $F_{B\ 2}$ perpendicular to component $F_{B\ 1}$. Let the direction from D to M be a positive direction. In the embodiment, the force $F_B$ is set such that the component $F_{B\ 1}$ extends in the direction DM (positive). Further, as shown in FIG. 5, assume that the drum 1 has an axis O which is connected to the axis M of the second conveying means 45 by a line MO (let the direction from M to O be a positive direction), and that the force $F_B$ is divided into a component $F_{B3}$ extending in the direction of the line MO, and a component $F_{B4}$ perpendicular to the component $F_{B\ 3}$. Then, if the component $F_{B\ 3}$ extends in the direction MO (positive), the force $F_B$ successfully causes a constant pressure to act between the conveying means 43 and 45 and between the conveying means 45 and the drum 1. This makes it needless to increase the amount of bite between the nearby rotary bodies. As a result, the lives of the rotary bodies are prevented from being reduced, and defective images are obviated.

2nd Embodiment

A reference will be made to FIGS. 6–13 for describing a second embodiment of the contact structure. During development, the friction between the first and second conveying means 43 and 45 exerts a force on the axis M of the conveying means 45. Also, the friction between the second conveying means 45 and the drum 1 exerts a force on the axis M of the conveying means 45. Assuming that the resultant of such two forces acting on the axis M is $F_M$, this embodiment is characterized in that the resultant $F_M$ includes a component parallel to a line OM, connecting the axis O of the drum 1 and the axis M of the conveying means 45, and directed from the axis M toward the axis O. Some specific configurations of this embodiment will be described hereinafter.

In the image forming apparatus, the drum 1 and second conveying means 45 and the second conveying means and first conveying means 43 rotate while abutting against each other, as described above. Hence, unless the adjoining rotary bodies rotate at the same speed in the same direction at their contact point, friction occurs at the contact point and acts on their axes. The size and direction of the friction acting on the axes depends on the contact pressure acting between the rotary bodies, and the directions and speeds of rotation of the rotary bodies with toner layers intervening between them.

1st Configuration

Figure 6:
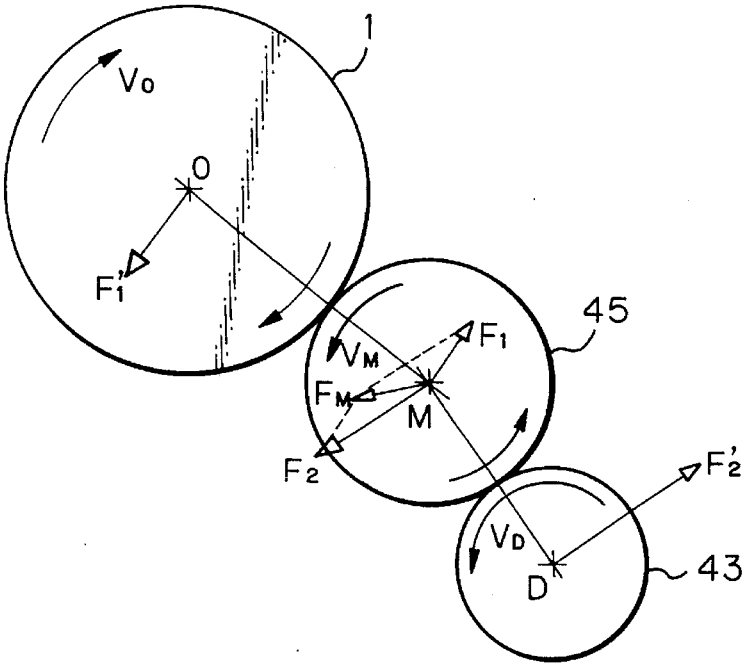
FIGS. 6–13 respectively show a first to an eighth specific configuration included in a second embodiment of the present invention.

As shown in FIG. 6, in the first configuration, the drum 1 is rotated clockwise, as in FIG. 3, while the second conveying means 45 is rotated counterclockwise (in the same direction as the drum 1 as seen at the contact point), but at a higher linear velocity than the drum 1. The first conveying means 43 is rotated counterclockwise, i.e., in the opposite direction to the second conveying means 45, as seen at the contact point. In the FIG. 6, arrows with solid heads each indicate the direction of rotation of the associated rotary body. The lengths of such arrows respectively indicate the rotations speeds VO, VD and VM of the drum 1, first conveying means 43, second conveying means 45. The speed VO is lower than the speed VM which is lower than the speed VD. The friction acts on the axis O of the drum 1 as a force $F'_1$, and acts on the axis M of the second conveying means 45 as a force $F_1$ identical in size with, but different in direction from, the force $F'_1$. Arrows with blank heads represent forces; their lengths represent the sizes of the forces. The first conveying means 43 rotates in the opposite direction (counterclockwise) to and at a higher linear velocity than the second conveying means 45 at the contact point, as stated above. Hence, the friction generated at this contact point acts on the axis M of the second conveying means 45 as a force $F_2$ and acts on the axis D of the first conveying means 43 as a force $F'_2$.

In the first configuration, the friction between the first and second conveying means 43 and 45 is assumed to be greater than the friction between the second conveying means 45 and the drum 1. The force acting on the axis M of the second conveying means 45 is the resultant of $F_1$ and $F_2$ and, therefore, $F_M$ shown in FIG. 6. When the axes O, D and M are aligned, the friction turns out tangential forces. Hence, the resultant $F_M$ is also a tangential component only, i.e., it does not act in the axis-to-axis direction. In contrast, when the lines OM and MD are not aligned, as in the specific configuration, the resultant $F_M$ includes a component extending in the direction OM. It follows that in the configuration of FIG. 6 the component of the resultant $F_M$ in the direction OM presses the second conveying means 45 toward the drum 1 during operation. This ensures stable contact without resorting to a greater amount of bite.

Moreover, the resultant $F_M$ causes the second conveying means 45 to play the role of a "wedge" between the drum 1 and the first conveying means 43, as will be described in detail later. This further enhances the stable contact of the rotary bodies 1 and 43 and of the rotary bodies 43 and 45.

In accordance with the present invention, the drum 1 may be implemented by any of an organic photoconductor and inorganic photoconductor (a-Si or Se). The second conveying means 45 may be implemented as, for example, a rubber roller with or without a coating of low friction material, a sponge roller covered with a rubber layer or a low friction material, or a roller covered with a tubular member. For the first conveying member 43, use may be made of a roller made of metal, rubber or plastics, a rubber magnet roller, or plastics magnet roller.

The rotation speeds of the rotary bodies 1, 43 and 45 depend on the amount of toner to be supplied. For example, assume that while the amount of toner to deposit on the first conveying means 43 should be relatively small (e.g. 0.3 mg/cm$^2$), the amount of toner to deposit on the second conveying means 45 should be greater than that (e.g. 0.7 mg/cm$^2$). Then first conveying means 43 is rotated at a higher speed than the second conveying means 45. As for a solid image having a substantial area, an amount of toner as great as about 0.7 mg/cm$^2$ to 1.0 mg/cm$^2$ is necessary. In such a case, the second conveying means 45 is rotated at a higher speed than the drum 1. These specific conditions are illustrated in FIG. 6.

When the amount of toner to deposit on the first conveying means 43 is selected to be small, it cannot cover the entire surface of the conveying means 43. In this condition, the friction between the two conveying means 43 and 45 slightly increases. At this instant, a sufficient amount of toner exists between the second conveying means 45 and the drum 1 and plays he role of a "lubricant", thereby reducing the friction between them. Eventually, the relation shown in FIG. 6 holds as the for force.

2nd Configuration

Figure 7:
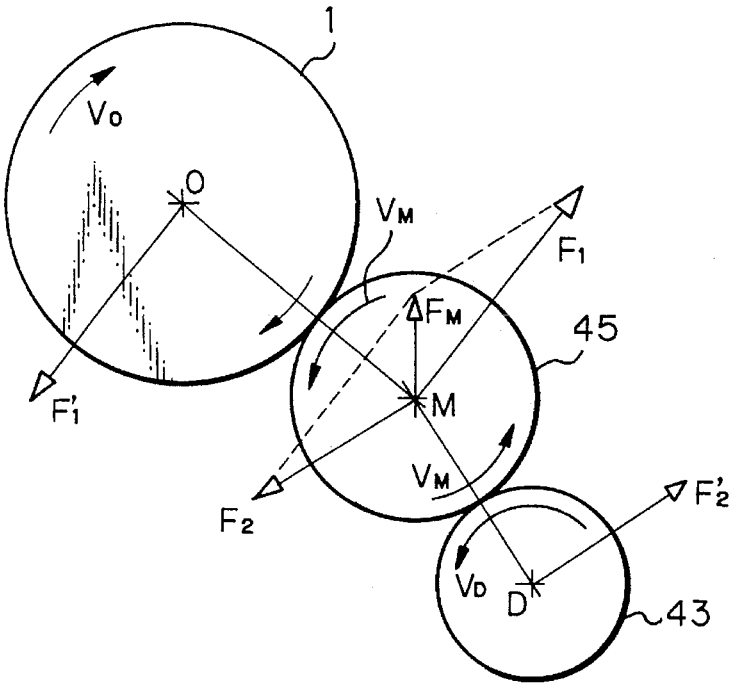
Figure 14:
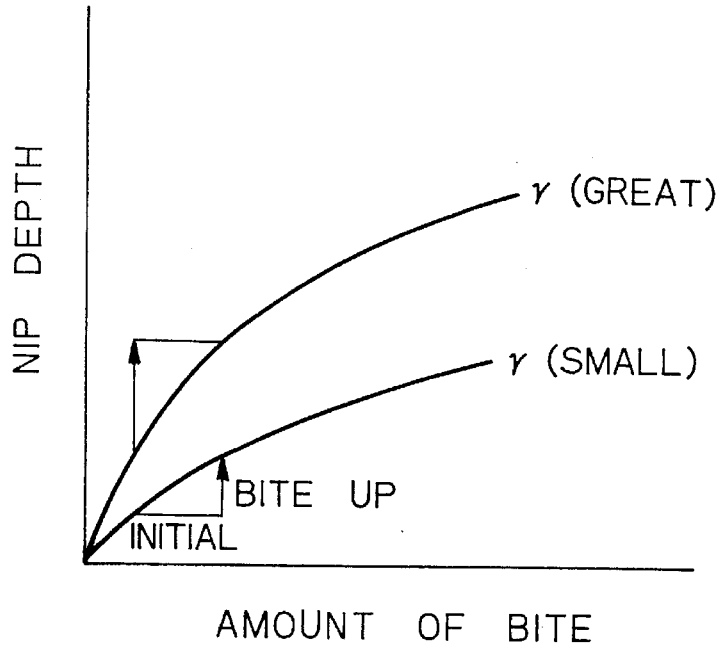
FIG. 14 is a graph representative of a relation between the amount of bite of a rotary body and the nip width.
Figure 15:
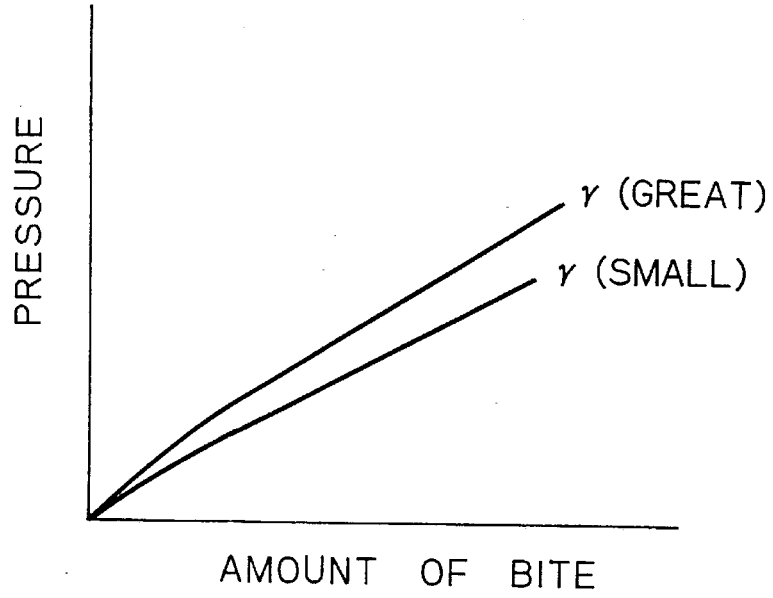
FIG. 15 is a graph representative of a relation between the amount of bite and the pressure.

Referring to FIGS. 7, 14 and 15, a second configuration of the second embodiment will be described. The drum 1 and first and second conveying means 43 and 45 have the same relation as to the direction and speed of rotation as the relation of the first configuration. However, in the second configuration, it may occur that the friction between the second conveying means 45 and the drum 1 is greater than the friction between the first and second conveying means 43 and 45, as shown in FIG. 7. Specifically, the friction between the conveying member 45 and the drum 1 increases if the toner is deposited on the conveying means 43 in a greater amount than in the first configuration in order to reduce the friction between the conveying means 43 and 45 and if the nip width between the conveying means 45 and the drum 1 is increased.

In the second configuration, the resultant $F_M$ of friction acting on the axis M of the first conveying means 45 includes a positive component in the direction MO. Hence, during operation, the resultant $F_M$ presses the conveying means 45 toward the drum 1 and thereby ensures the contact of the conveying means 45 and drum 1. However, because this resultant $F_M$ is directed away from, or leaves, the first conveying means 43, the contact between the two conveying means 43 and 45 must be implemented by the amount of bite.

The first conveying means 43 has a smaller radius of curvature than the second conveying means 45. Therefore, as FIGS. 14 and 15 indicate, even when the amount of bite is slightly increased, neither the pressure nor the nip width sharply increases, compared to a case wherein the conveying means 43 is greater in the radius of curvature than the conveying means 45. That is, the friction does not sharply increase and can be sufficiently coped with. It is to be noted that this kind of scheme would increase the pressure and friction if applied to the drum 1 having a great radius of curvature.

3rd Configuration

Figure 8:
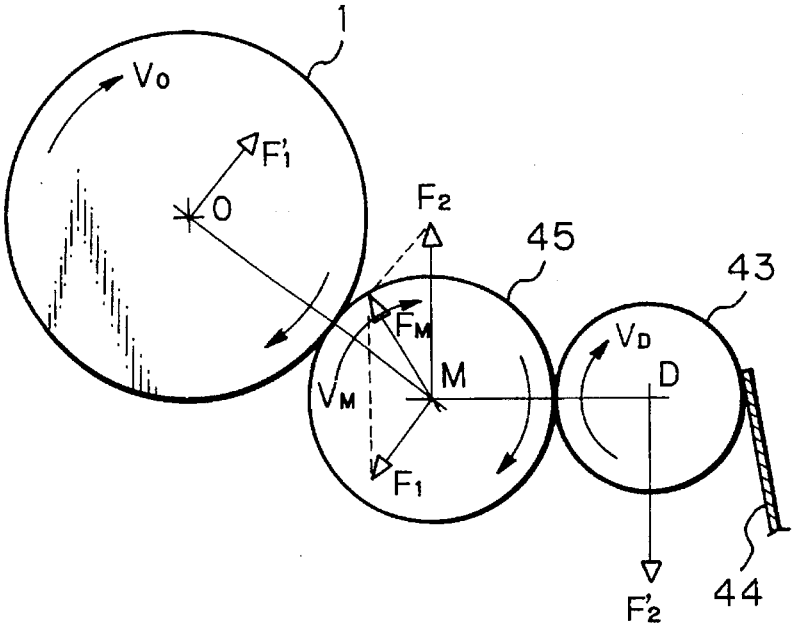

As shown in FIG. 8, the first conveying means 43 is rotated in a direction (clockwise) opposite to the direction of the first and second configurations. Hence, the regulating means 44 is located at a position opposite to the position shown in FIG. 3. Both the drum 1 and the second conveying means 45 are rotated clockwise. As shown, the friction due to the sliding contact acts on the axis O of the drum 1 as a force $F'_1$ and acts on the axis M of the second conveying means 45 as a force $F_1$ identical in size with, but different in direction from, the force $F'_l$. On the other hand, the first conveying means 43 is rotated in the opposite direction (counterclockwise) to and at a higher speed than the second conveying means 45, as seen at the contact point. The resulting friction acts on the axis M of the conveying means as a force $F_2$ and acts on the axis D of the conveying means 43 as a force $F'_2$.

The third configuration shows a case wherein the friction between the two conveying means 43 and 45 is greater than the friction between the conveying means 45 and the drum 1. The force acting on the axis M of the conveying means 45 is the resultant of the forces $F_1$ and $F_2$ and, therefore, $F_M$ shown in FIG. 8. As shown, when the lines OM and MD are not aligned, the resultant FM includes a component extending in the direction OM. It follows that in the condition of FIG. 8 the component of the resultant $F_M$ in the direction OM presses the conveying means 45 toward the drum 1 during operation. Again, this ensures stable contact without resorting to a greater amount of bite.

Further, in this configuration, the resultant $F_M$ allows the second conveying means 45 to play the role of a wedge between the drum 1 and the first conveying means 43, thereby further ensuring the stable contact of the rotary bodies 1, 43 and 45.

4th Configuration

Figure 9:
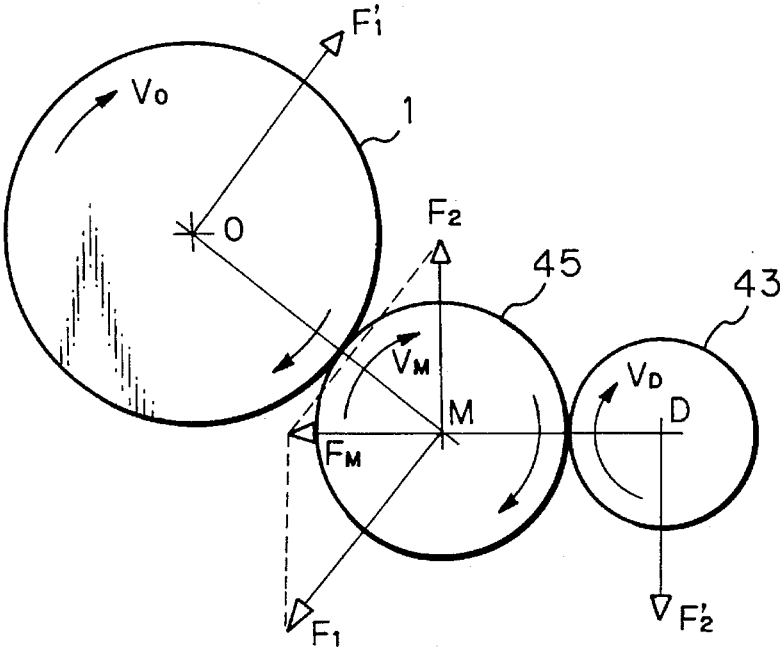
Figure 10:
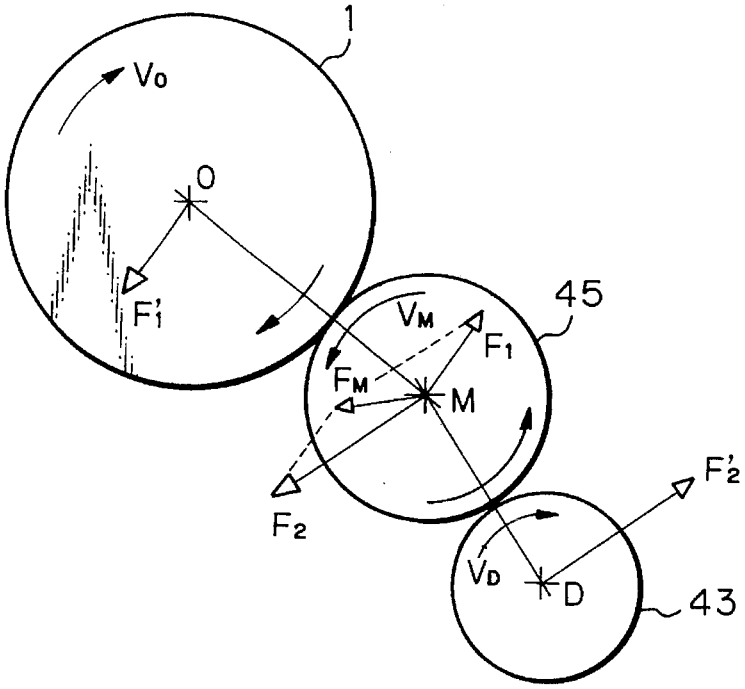
Figure 11:
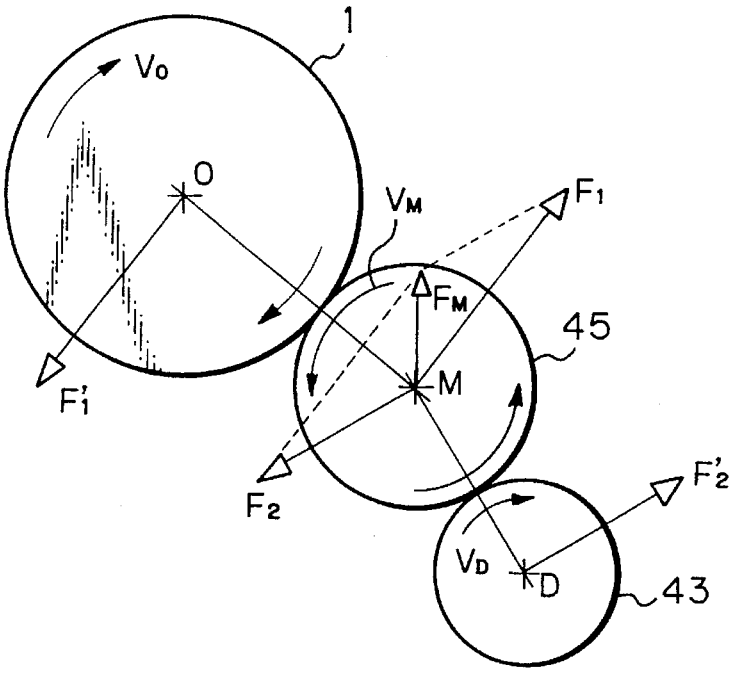
Figure 12:
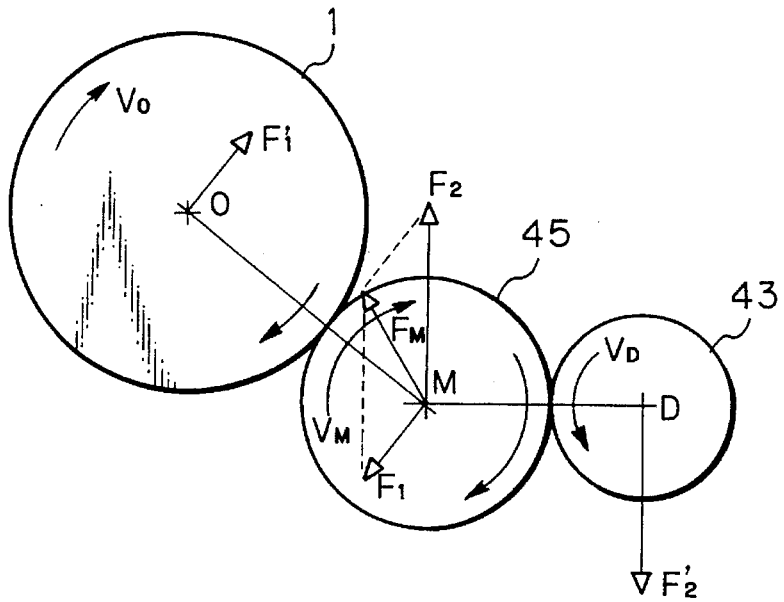
Figure 13:
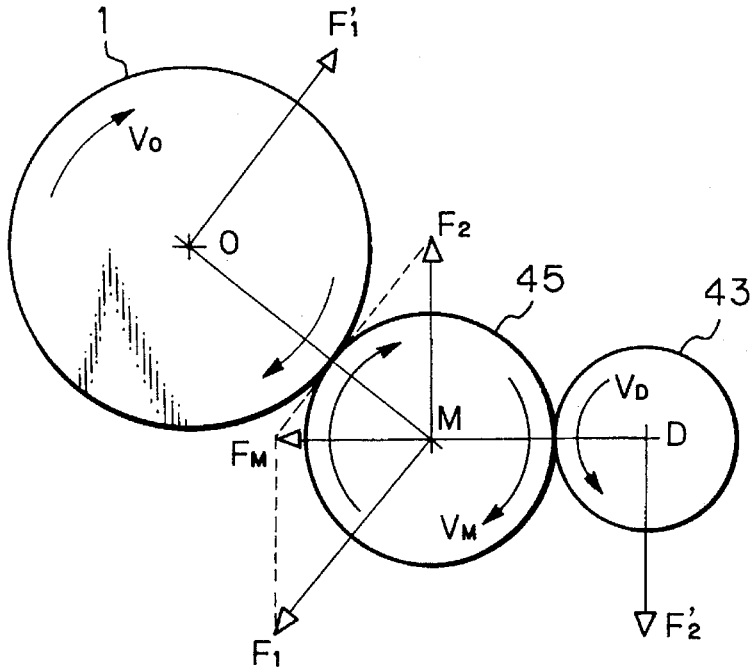

Referring to FIG. 9, a fourth configuration has the drum 1 and first and second conveying means 43 and 45 rotated in the same relation as in the third configuration as to the direction and speed. With this configuration, it may occur that the friction between the second conveying means 45 and the drum 1 is greater than the friction between the two conveying means 43 and 45, as shown in FIG. 9. Specifically, the friction between the conveying means 45 and the drum 1 increases if the toner is deposited on the first conveying means 43 in a greater amount than in the third configuration in order to reduce the friction between the two conveying means 43 and 45 and if the nip width between the conveying means 45 and the drum 1 is increased. It is to be noted that the resultant $F_M$ is directed away from, or leaves, the conveying means 43.

5th to 8th Configurations

FIGS. 10, 11, 12 and 13 show fifth to eighth configurations, respectively. As shown, the second conveying means 45 is rotated at a higher speed than the first conveying means 43. In this configuration, the amount of toner deposition is smaller on the second conveying means 45 than on the first conveying means 43. This, however, does not matter at all in the aspect of development because the linear velocity ratio of the second conveying means 45 to the first conveying means 43 increases. In the configurations shown in FIGS. 10 and 11, the drum 1 and first conveying means 43 are rotated clockwise while the second conveying means 45 is rotated counterclockwise; the regulating means 44 is located at the same position as in the third configuration of FIG. 8. In the configurations shown in FIGS. 12 and 13, the drum 1 and second conveying means 45 are rotated clockwise while the first conveying means 43 is rotated counterclockwise; the regulating means 44 is located at the same position as in FIG. 3.

In the fifth and seventh configurations, the friction between the first and second conveying means 45 is greater than the friction between the second conveying means 45 and the drum 1. The resultant $F_M$ of such friction causes the conveying means 45 to play the role of a wedge between the drum 1 and the conveying means 43.

On the other hand, in the sixth and eighth configurations, the friction between the second conveying means 45 and the drum 1 is greater than the friction between the first and second conveying means 45. The resultant $F_M$ is directed away from, or leaves, the first conveying means 43.

In the second embodiment described above, the friction between the first and second conveying means 43 and 45 during development exerts a force on the axis M of the conveying means 45. The friction between the second conveying means 45 and the drum 1 also exerts a force on the axis M of the conveying means. The resultant of such two forces includes a component parallel to the line OM and directed from the axis M toward the axis O. Consequently, the rotary bodies 1, 43 and 45 are surely held in contact without having their lives reduced.

3rd Embodiment

Referring to FIGS. 16, 17, 18 and 19, specific configurations of a third embodiment will be described hereinafter.

1st Configuration

The resultant $F_M$ of the friction between the drum 1 and the first conveying means 43 and the friction between the first and second conveying means 43 and 45 acts on the axis M of the conveying means 45, as stated in relation to the second embodiment. In the configuration shown in FIG. 16, the drum 1 is rotated clockwise (as in FIG. 3) while the second conveying means 45 is rotated in the opposite direction (clockwise) to and at a higher linear velocity than the drum 1, as seen at the contact point. The resulting friction acts on the axis O of the drum 1 as a force $F'_1$ and acts on the axis M of the second conveying means as a force $F_1$ identical in size with, but different in direction from, the force $F'_l$. The first conveying means 43 is rotated in the same direction (counterclockwise) as, but at a higher linear velocity than, the second conveying means 45, as seen at the contact point. The resulting friction acts on the axis M of the second conveying means 45 as a force $F_2$ and acts on the axis D of the first conveying means 43 as a force $F'_2$.

Figure 16:
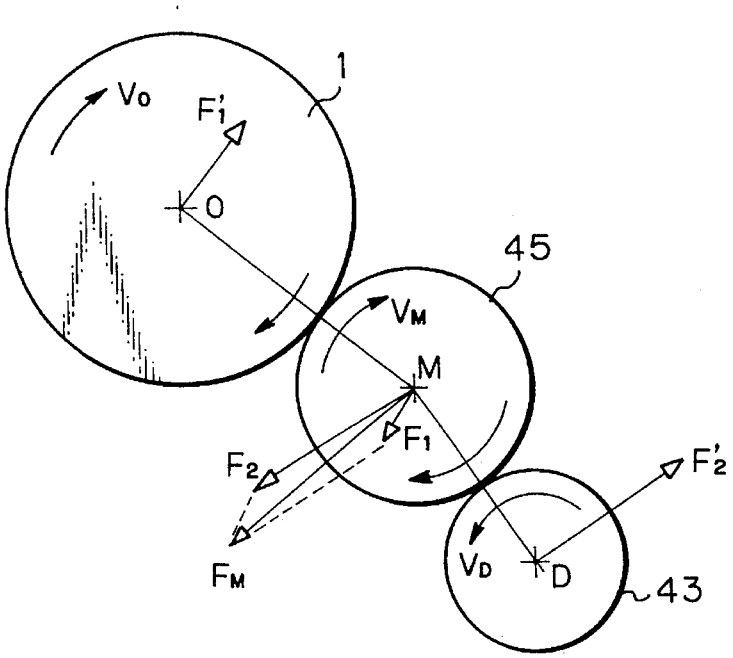
FIGS. 16–19 respectively show a first to a fourth specific configurations included in a third embodiment of the present invention.
Figure 17:
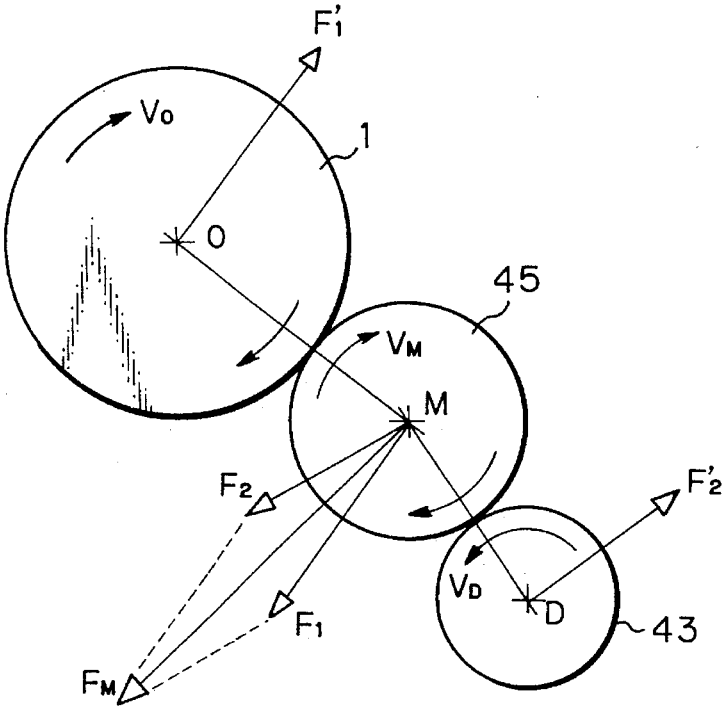

FIG. 16 shows a condition wherein the friction between the first and second conveying means 43 and 45 is greater than the friction between the second conveying means 45 and the drum 1. The force acting on the axis M of the second conveying means 45 is the resultant of the forces $F_l$ and $F_2$ and, therefore, $F_M$ shown in FIG. 16. In this condition, the resultant $F_M$ is contained in a smaller one of the angles OMD between the lines MO and DM. As a result, the second conveying means 45 serves as a wedge between the drum 1 and the first conveying means 43, thereby ensuring stable contact.

2nd Configuration

This configuration, in contrast to the first configuration, causes greater friction to act between the second conveying means 45 and the drum 1 than between the first and second conveying means 43 and 45. This occurs when the toner is deposited on the first conveying means 43 in a greater amount than in the first configuration in order to reduce the friction between the conveying means 43 and 45 and when the nip width between the conveying means 45 and the drum 1 is increased. The rotary bodies are held in the same relation as in the first configuration as to the direction and speed of rotation.

3rd and 4th Configurations

Figure 18:
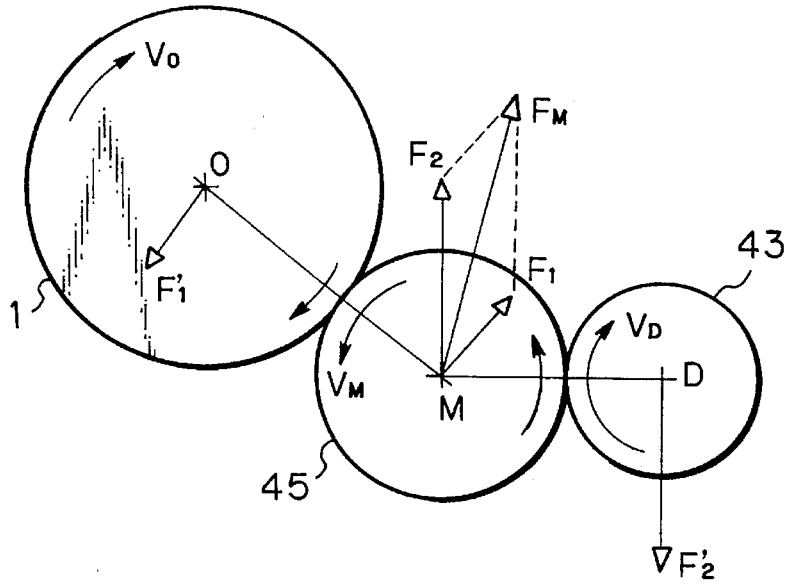
Figure 19:
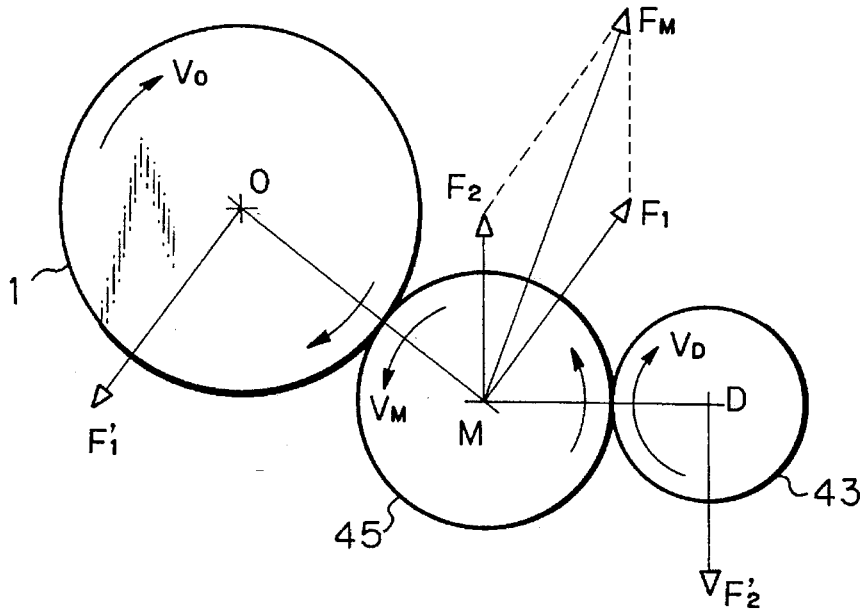

FIGS. 18 and 19 show a third configuration and a fourth configuration, respectively. As shown, the first conveying means 43 (as well as the second conveying means 45) is rotated in a direction opposite to the direction of the first and second configurations. Hence, the toner regulating means 44 is located at a position opposite to the position shown in FIG. 3.

In the third configuration, the friction between the second conveying means 45 and the drum is smaller than the friction between the first and second conveying means 43 and 45. In the fourth configuration, the friction between the second conveying means 45 and the drum 1 is greater than the friction between the first and second conveying means 43 and 45. As shown in FIG. 18, the resulting friction acts on the axis O of the drum 1 as a force $F'_l$ and acts on the axis M of the second conveying means 45 as a force $F_1$ identical in size with, but different in direction from, the force $F'_l$. Further, the first conveying means 43 is rotated in the opposite direction (counterclockwise) to and at a higher linear velocity than the second conveying means 45, as seen at the contact point. Hence, the friction at this contact point acts on the axis M of the second conveying means 45 as a force $F_2$ and acts on the axis D of the first conveying means 43 as a force $F'_2$.

In the third configuration, the friction between the two conveying means 43 and 45 is greater than the friction between the conveying means 45 and the drum 1. The force acting on the axis M of the conveying means 45 is the resultant of $F_1$ and $F_2$ and, therefore, $F_M$ shown in FIG. 18.

As shown in FIG. 19, the fourth configuration is such that the friction between the second conveying means 45 and the drum 1 is greater than the friction between the first and second conveying means 43 and 45. The force acting on the axis M of the second conveying means is the resultant of $F_1$and $F_2$ and, therefore, $F_M$ shown in FIG. 19.

As stated above, in the second to fourth configurations, the resultant $F_M$ is also contained in a smaller one of the angles OMD between the lines MO and DM. As a result, the second conveying means 45 serves as a wedge between the drum 1 and the first conveying means 43, thereby ensuring stable contact.

in the third embodiment, the friction between the first and second conveying means 43 and 45 exerts a force on the axis M of the second conveying means 45 during development. Also, the friction between the second conveying means 45 and the drum 1 exerts a force on the axis M of the second conveying means 45. The resultant $F_M$ of such two forces is contained in a smaller one of the angles between the lines MO and DM. This ensures stable contact without reducing the lives of the rotary bodies 1, 43 and 45.

As stated above, in the specific configurations of the second and third embodiments, the resultant includes a component $M_O$ and urges the second conveying means 45 toward the drum 1 so as to maintain them in accurate contact. When the resultant implements a "wedge", it maintains the contact of the rotary bodies, including the first conveying means 43, more stable. Further, when the resultant acts in a "leaving" direction, neither the pressure nor the nip width sharply increases even when the amount of bite is increased, because the first conveying means 43 is smaller in the radius of curvature than the second conveying means 45. Therefore, if the amount of bite is increased, the "leaving" can be absorbed without inviting a sharp increase in friction. This successfully maintains the first and second conveying means 43 and 45 in stable contact. Considering the wear and jitter of the drum 1, it is preferable that the drum 1 and second conveying means 45 be only slightly different in peripheral speed and be rotated in the same direction, as seen at the contact point. To increase the amount of toner supply, the first conveying means 43 should preferably be rotated at a higher speed than and in the opposite direction to the second conveying means 45, as viewed at the contact point. The configurations shown in FIGS. 6 and 7 satisfy such conditions.

The embodiments shown and described have omitted a case wherein the drum 1 is rotated at a higher speed than the second conveying means 45. Even in such a case, the rotary bodies can be held in stable contact if the principle described above is applied.

In summary, it will be seen that the present invention provides a developing device whose rotary bodies can be stably held in contact with each other without having their lives reduced.

Various modifications will become possible for those skilled in the art after receiving the teachings of the present disclosure without departing from the scope thereof.

What is claimed is:

1. A developing device for a developing apparatus and for developing a latent image electrostatically formed on an image carrier by toner, comprising:

first rotatable conveying means for causing the toner to deposit on a surface thereof;

regulating means for regulating an amount of the toner deposited on the surface of said first conveying means; and second conveying means for causing the toner transferred from the surface of said first conveying means and regulated by said regulating means to deposit on said second conveying means, and for supplying said toner to the latent image;

wherein a pressure of said regulating means, abutting against said first conveying means, includes both a component parallel to a line connecting axes of said first and second conveying means, and directed from said axis of said first conveying means to said axis of said second conveying means, and a component parallel to a line connecting said axis of said second conveying means and an axis of the image carrier, and directed from said axis of said second conveying means toward said axis of said image carrier.

2. A developing device for a developing apparatus and for developing a latent image electrostatically formed on an image carrier by toner, comprising:

first rotatable conveying means for causing the toner to deposit on a surface thereof;

regulating means for regulating an amount of the toner deposited on the surface of said first conveying means; and second conveying means for causing the toner transferred from the surface of said first conveying means and regulated by said regulating means to deposit on said second conveying means, and for supplying said toner to the latent image;

wherein a resultant of a force exerted, during development, on an axis of said second conveying means by friction with the first conveying means and a force exerted on said axis of said second conveying means by friction between said second conveying means and the image carrier includes a component parallel to a line connecting an axis of said image carrier and said axis of said second conveying means, and directed from said axis of said second conveying means toward said axis of said image carrier.

3. A developing device for a developing apparatus and for developing a latent image electrostatically formed on an image carrier by toner, comprising:

first rotatable conveying means for causing the toner to deposit on a surface thereof;

regulating means for regulating an amount of the toner deposited on the surface of said first conveying means; and second conveying means for causing the toner transferred from the surface of said first conveying means and regulated by said regulating means to deposit on said second conveying means, and for supplying said toner to the latent image;

wherein a resultant of a force exerted, during development, on an axis of said second conveying means by friction between said first and second conveying means and a force exerted on said axis of said second conveying means by friction between said second conveying means and the image carrier is contained in a smaller one of a first angle between a line connecting an axis of said first conveying means and said axis of said second conveying means and a second angle between a line connecting said axis of said second conveying means and an axis of said image carrier.

4. A developing device for a developing apparatus and for developing a latent image electrostatically formed by toner on an image carrier rotating at a peripheral speed of 67 mm/sec, comprising:

first rotatable conveying means for causing the toner to deposit on a surface thereof, and rotating at a peripheral speed of 224 mm/sec;

regulating means for regulating an amount of the toner deposited on the surface of said first conveying means; and second rotatable conveying means for causing the toner transferred from the surface of said first conveying means and regulated by said regulating means to deposit on said second conveying means, and for supplying said toner to the latent image, and rotating at a peripheral speed of 70 mm/sec;

wherein a resultant of a force exerted, during development, on an axis of said second conveying means by first friction with the first conveying means and a force exerted on said axis of said second conveying means by second friction between said second conveying means and the image carrier includes a component parallel to a line connecting an axis of said image carrier and said axis of said second conveying means, and directed from said axis of said second conveying means toward said axis of said image carrier.

5. The developing device according to claim 4, wherein the image carrier rotates clockwise and the first and second rotatable conveying means rotate counterclockwise.

6. The developing device according to claim 4, wherein the first friction is greater than the second friction.

* * * * *